US011334031B2

(12) United States Patent
Fujiwara et al.

(10) Patent No.: US 11,334,031 B2
(45) Date of Patent: May 17, 2022

(54) TIMEPIECE MOVEMENT AND TIMEPIECE

(71) Applicant: Seiko Instruments Inc., Chiba (JP)

(72) Inventors: Toshiyuki Fujiwara, Chiba (JP); Kenji Ogasawara, Chiba (JP)

(73) Assignee: SEIKO INSTRUMENTS INC., Chiba (JP)

( * ) Notice: Subject to any disclaimer, the term of this patent is extended or adjusted under 35 U.S.C. 154(b) by 482 days.

(21) Appl. No.: 16/597,331

(22) Filed: Oct. 9, 2019

(65) Prior Publication Data

US 2020/0133205 A1 Apr. 30, 2020

(30) Foreign Application Priority Data

Oct. 24, 2018 (JP) ..... JP2018-200053

(51) Int. Cl.

| | |
|---|---|
| ***G04B 13/02*** | (2006.01) |
| ***G04C 3/14*** | (2006.01) |
| ***G04C 3/00*** | (2006.01) |
| *G04C 13/11* | (2006.01) |

(52) U.S. Cl.

CPC ..... *G04C 3/146* (2013.01); *G04C 3/008* (2013.01); *G04C 3/143* (2013.01); *G04C 13/11* (2013.01)

(58) Field of Classification Search

CPC ..... G04C 13/11; G04C 3/143; G04C 3/146; G04C 3/008; G04B 13/02; G04B 19/28; G04B 19/044

See application file for complete search history.

(56) References Cited

U.S. PATENT DOCUMENTS

| | | | | |
|---|---|---|---|---|
| 7,625,116 | B2 * | 12/2009 | Bron | G04B 19/02 368/106 |
| 8,717,853 | B2 * | 5/2014 | Courvoisier | G04B 19/06 116/300 |
| 10,139,783 | B2 * | 11/2018 | Matsuzawa | G04G 9/0064 |
| 2007/0097794 | A1 * | 5/2007 | Suzuki | G04B 19/247 368/28 |
| 2008/0084792 | A1 | 4/2008 | Hayashi et al. | |
| 2008/0106979 | A1 * | 5/2008 | Bron | G04B 19/02 368/190 |
| 2012/0067271 | A1 * | 3/2012 | Courvoisier | G04B 19/06 116/300 |
| 2017/0261934 | A1 * | 9/2017 | Matsuzawa | G04C 17/0091 |

* cited by examiner

*Primary Examiner* — Sean Kayes
(74) *Attorney, Agent, or Firm* — Crowell & Moring LLP

(57) ABSTRACT

A timepiece movement capable of suppressing generation of malfunction of a hand is provided. The movement includes an indicator hand wheel which is provided so as to be rotatable and to which an indicator hand is mounted; an indicator hand stepping motor rotating and driving the indicator hand wheel in both directions; an hour wheel provided so as to be rotatable around a first rotation axis different from a rotation axis of the indicator hand wheel and having a first shaft portion which extends along the first rotation axis and on the outer peripheral surface of which there is provided a contact portion that the indicator hand can abut, with the distance of the contact portion from the first rotation axis varying in accordance with a position in the peripheral direction around the first rotation axis; and an hour hand stepping motor rotating and driving the hour wheel and provided separately from the indicator hand stepping motor.

9 Claims, 9 Drawing Sheets

TIMEPIECE MOVEMENT AND TIMEPIECE

RELATED APPLICATIONS

This application claims priority to Japanese Patent Application No. 2018-200053, filed on Oct. 24, 2018, the entire content of which is incorporated herein by reference.

BACKGROUND OF THE INVENTION

1. Field of the Invention

The present invention relates to a timepiece movement and a timepiece.

2. Description of the Related Art

Conventionally, in an electronic timepiece driving hands by a stepping motor, there is mounted a mechanism correcting the hand position. In a timepiece in which the rotational range of the hands is specified, there is adopted a hand position correction method in which a wheel with a hand mounted thereto is rotated to an end portion of the rotational range for abutment. (See, for example, JP-A-2008-116435 (Patent Document 1.)) Patent Document 1 discloses a timepiece equipped with a fan-shaped indicator portion having a rotatable indicator wheel, a stepping motor rotating and driving the indicator wheel in both normal and reverse directions, a normal rotation abutment portion regulating the rotation of the indicator wheel to the normal side, and an indicator means mounted to the indicator wheel.

However, when the indicator wheel is at rest as a result of abutment, there are cases where, depending on the rotational position of the rotor of the stepping motor, the rotor does not rotate but is stuck even if a pulse is applied to the stepping motor. In view of this, in the invention disclosed in Patent Document 1, the position of the normal rotation abutment portion is set such that the pair of magnetic pole directions of the rotor when the indicator wheel is at rest as a result of abutment at the normal rotation abutment portion are deviated from the range of ±30° with respect to the kinematically stable position. As a result, after the normal rotation abutment, the rotor can be reliably driven through the application of a reverse signal.

In recent years, there is a timepiece in which, apart from the hour/minute hands, etc., rotating around a position near the center of the dial, there is provided an indicator hand rotating around a position deviated from the rotation center of the hour/wheel hands, providing a function by which various items of information other than time are displayed. In a timepiece of this type, it is necessary for the indicator hand not to come into contact with the shaft portion of the hour/minute hands, etc. That is, in the case where the indicator hand extends longer than the inter-shaft distance between the shaft portion of the hour/minute hands and the shaft portion of the indicator hand, the timepiece is designed such that the indicator hand rotates within a range where it does not come into contact with the shaft portion of the hour/minute hands, etc., to display information.

In the conventional timepiece equipped with an indicator hand, however, it may occur that the indicator hand is deviated from the normal rotational range due to an unexpected situation such as an excessive application of pluses, resulting in the indicator hand abutting the shaft portion of the hour/minute hands, etc. In such cases, it is difficult to predict the rotational position of the rotor in the state in which the indicator hand has undergone abutment. Thus, the timepiece is in a stuck state in which the rotor does not rotate even if a pulse is applied to the stepping motor, and there is the possibility of malfunctioning of the indicator hand being caused.

SUMMARY OF THE INVENTION

It is an aspect of the present application to provide a timepiece movement and a timepiece capable of suppressing generation of malfunctioning of the hands.

In accordance with the present application, there is provided a timepiece movement including a first wheel which is provided so as to be rotatable and to which a hand is mounted; a first motor rotating and driving the first wheel in both directions; a second wheel provided so as to be rotatable around an axis different from a rotation axis of the first wheel and having a shaft portion which extends along the axis and on an outer peripheral surface of which there is provided a contact portion the hand can abut, with the distance of the contact portion from the axis varying in accordance with a position in a peripheral direction around the axis; and a second motor rotating and driving the second wheel and provided separately from the first motor.

In accordance with the present application, the second wheel is rotated in a state in which the hand is in contact with the contact portion of the shaft portion of the second wheel, whereby it is possible to provide a gap between the hand and the shaft portion of the second wheel or to press the hand to displace it. As a result, even in the case where the hand comes into contact with the second wheel to place the rotor in a state in which it is unrotatable, it is possible to rotate the rotor. Thus, it is possible to suppress generation of malfunction of the hand.

In the above timepiece movement, it is desirable for the contact portion to have a face-cut portion.

According to the present application, due to the face-cut portion, the distance of the contact portion from the axis can be varied in accordance with the position in the peripheral direction around the axis. Thus, it is possible to form a timepiece movement providing the above-mentioned effect.

In the above timepiece movement, it is desirable for the contact portion to have a pair of face-cut portions provided parallel to each other.

According to the present application, by rotating the second wheel by at least 180°, it is possible to provide a gap between the hand and the shaft portion of the second wheel, or to press the hand to displace it. That is, as compared with the case where there is provided only one face-cut portion, it is possible to provide a gap between the hand and the shaft portion of the second wheel, or to press the hand to displace it more quickly.

Further, at least a part of the contact portion is a portion which does not depend on the distance from the axis of the pair of face-cut portions and which is at a larger distance from the axis than the face-cut portion. Thus, the maximum distance from the axis of the contact portion does not change even when the face-cut portion is provided. That is, as compared with the case where there are provided three or more face-cut portions, it is possible to provide a larger gap between the hand and the shaft portion of the second wheel, or to press the hand to displace it more greatly.

Due to the above structure, even in the case where the hand comes into contact with the second wheel and where the rotor is placed in a state in which it is unrotatable, it is possible to rotate the rotor more reliably. Thus, it is possible to suppress generation of malfunction of the hand.

In the above-described timepiece movement, it is desirable for the contact portion to be offset with respect to the axis.

According to the present application, it is possible to vary the distance of the contact portion from the axis in accordance with the position in the peripheral direction around the axis. Thus, it is possible to form a timepiece movement providing the above-mentioned effect.

In the above-described timepiece movement, it is desirable for the first motor to be equipped with a stator having one coil, and a 2-pole rotor.

According to the present application, when reversing the rotor, there is a case where a pulse rotating the rotor normally is first applied to the coil. Thus, when the hand comes into contact with the shaft portion of the second wheel through normal rotation of the rotor, it is impossible to further rotate the rotor normally, so that the rotor is placed in a state in which it is irreversible. Thus, through combination of the second wheel having the above-mentioned contact portion, it is possible to provide a timepiece movement capable of escaping the state in which the rotor is irreversible.

In the above-described timepiece movement, the stator is equipped with a stator yoke having a rotor accommodating hole in which the rotor is arranged; the stator yoke is equipped with a pair of magnetic saturation portions generating a pair of magnetic poles different from each other around the rotor accommodating hole through excitation of the coil; the pair of magnetic saturation portions are provided so as to be opposite each other with the rotation center of the rotor therebetween; in the rotor accommodating hole, there are formed a pair of cutout portions exerting a retaining torque to the rotor; the pair of cutout portions are provided so as to be opposite each other with the rotation center of the rotor therebetween; a straight line passing through the pair of cutout portions is inclined by a predetermined angle in the normal rotation direction of the rotor with respect to a straight line passing through the pair of magnetic saturation portions; and the contact portion is preferably formed such that when normally rotating the rotor, when the second wheel is rotated in a state in which the hand is held in contact with the contact portion from the upstream side in the hand displacement direction, the rotor rotates to a greater degree than the predetermined angle.

Here, the direction in which the hand rotates when the rotor is caused to make normal rotation will be referred to as the first direction. According to the present application, in the state in which the magnetic pole axis of the rotor is situated at a position where it is orthogonal to the straight line passing through the pair of magnetic saturation portion, the rotor strives to make normal rotation toward a position where the magnetic pole axis is orthogonal to a straight line passing through a pair of inner notches. In the case where the hand comes into contact with the portion of the contact portion of the second wheel most spaced away from the axis from the upstream side in the first direction, when the second wheel is rotated to rotate the hand in the first direction, the rotor makes normal rotation to a stationary stable position by the predetermined angle θ, and comes to rest at the stationary stable position. When the second wheel is further rotated, a gap is formed between the hand and the shaft portion of the second wheel as the rotor stops. As a result, it is possible to normally rotate the rotor, so that it is possible to reverse the rotor by the above-mentioned pulse. Thus, it is possible to suppress generation of malfunction of the hand.

In the above-described timepiece movement, there is provided a control portion controlling the first motor and the second motor; and in the case where the hand comes into contact with the contact portion of the second wheel, each time the pulse rotating the second wheel is applied to the second motor a predetermined number of times, the control portion preferably applies a pulse rotating the hand away from the second wheel to the first motor once.

According to the present application, it is possible to periodically apply a reversing pulse to the first motor. As a result, even if the contact position of the hand at the contact portion of the second wheel is unclear, it is possible to apply a reversing pulse to the first motor in the state in which a gap is formed between the hand and the shaft portion of the second wheel or in the state in which the hand is pressed and displaced by the second wheel. Thus, it is possible to reliably escape the state in which the rotor is unrotatable.

In the above-described timepiece movement, it is desirable for the predetermined number of times to be one.

According to the present application, it is possible to reliably apply a reversing pulse to the first motor in the state in which a gap is formed between the hand and the shaft portion of the second wheel, or in the state in which the hand is pressed and displaced by the second wheel. Thus, it is possible to escape more reliably from the state in which the rotor is unrotatable.

In the timepiece of the present application, there are provided the above-mentioned timepiece movement, a first hand mounted to the first wheel, and a second hand mounted to the second wheel.

According to the present application, it is possible to provide a timepiece in which generation of malfunction of the first hand is suppressed.

According to the present application, it is possible to provide a timepiece movement and a timepiece in which it is possible to suppress generation of malfunction of the hand.

DETAILED DESCRIPTION OF THE PREFERRED EMBODIMENTS

Figure 1:
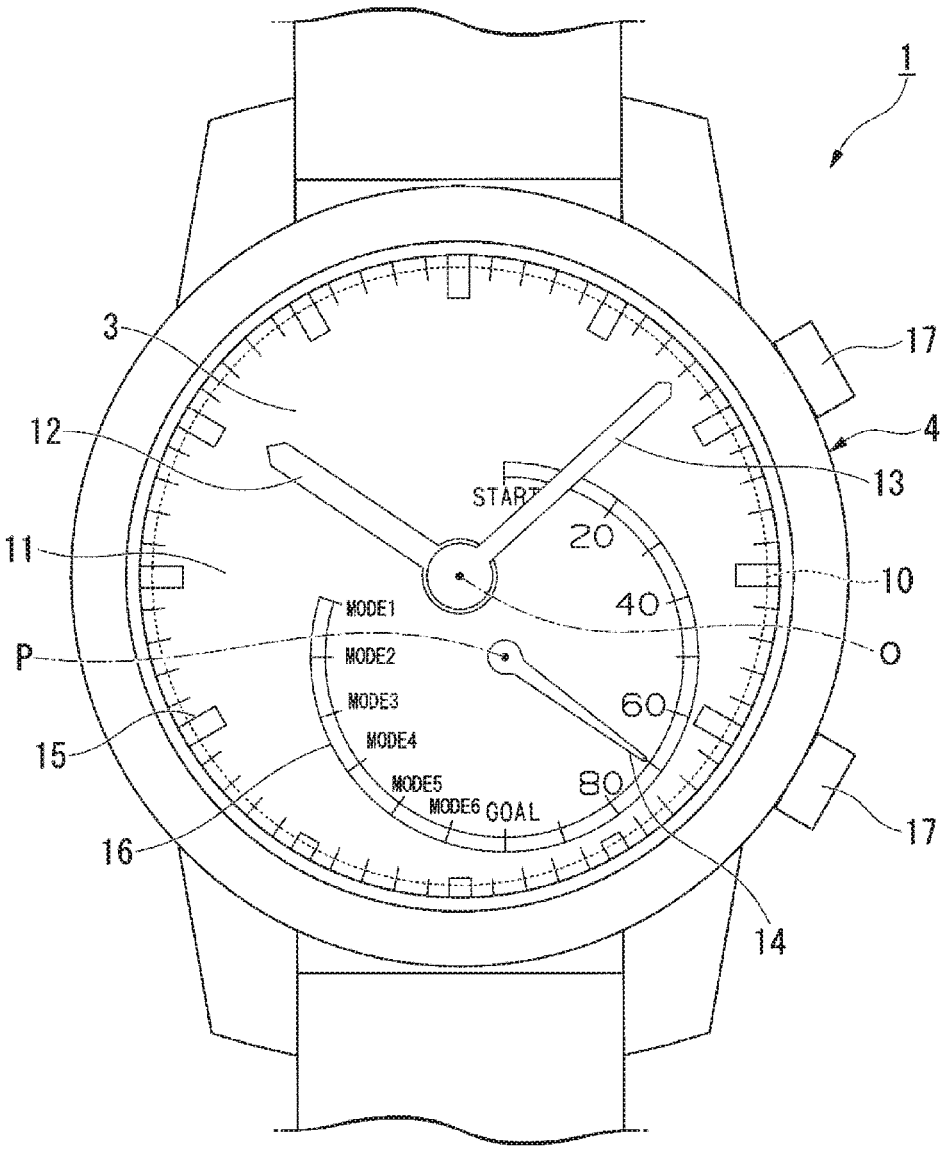
FIG. 1 is a plan view of a timepiece according to a first embodiment.

In the following, embodiments of the present invention will be described with reference to the drawings. In the following embodiments, an analog quartz type electronic timepiece is taken as an example of a timepiece. In the following description, components of the same or equivalent function are indicated by the same reference numerals. A redundant description of such components may be left out.

First Embodiment

First, a timepiece 1 and a movement 10 according to the first embodiment will be described.

(Timepiece)

A mechanical body including a drive portion of a timepiece is generally referred to as a "movement." A dial and indicator hands are mounted to this movement, and the whole is put in a timepiece case. The resultant complete whole thus obtained is referred to as the "complete" of the timepiece.

FIG. 1 is a plan view of the timepiece of the first embodiment.

As shown in FIG. 1, the complete of the timepiece 1 is equipped with the movement 10, a dial 11, an hour hand 12, a minute hand 13, and an indicator hand 14 (hand) inside a timepiece case 4 including a case back (not shown) and a glass 3. The hour hand 12 and the minute hand 13 indicate time. The hour hand 12 and the minute hand 13 are mounted to a first output shaft 21 (See FIG. 2) provided in the movement 10, and rotate around a first rotation axis O (axis). The first rotation axis O is the center axis of the first output shaft 21. The indicator hand 14 indicates information different from time information indicated by the hour hand 12 and the minute hand 13, such as the kind of mode being executed by the timepiece 1. The indicator hand 14 is mounted to a second output shaft 22 (See FIG. 2) provided in the movement 10, and rotates around a second rotation axis P different from the first rotation axis O. The second rotation axis P, which is the center axis of the second output shaft 22, is provided parallel to the first rotation axis O.

Figure 2:
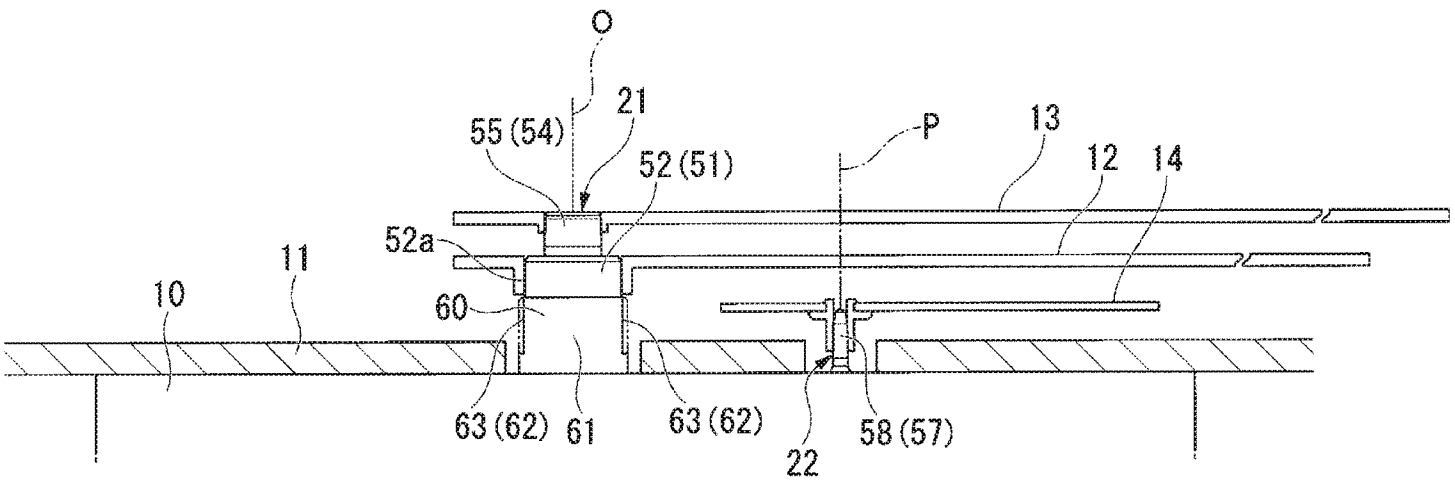
FIG. 2 is a sectional view of the timepiece of the first embodiment.

The distance from the second rotation axis P to the distal end of the indicator hand 14 is longer than the distance from the second rotation axis P to the first output shaft 21 (See FIG. 2). As a result, the rotational range of the indicator hand 14 is normally less than 360°, and is set to a fan-shaped configuration avoiding the first output shaft 21.

The dial 11 is formed in a disc-like configuration. The dial 11 has a main display region corresponding to the hour hand 12 and the minute hand 13, and a sub display region 16 corresponding to the indicator hand 14. In the main display region 15, there is provided a scale indicated by the distal ends of the hour hand 12 and the minute hand 13 in a circumferential shape along the outer periphery of the dial 11. In the sub display region 16, there are provided a scale, letters, etc., indicated by the distal end of the indicator hand 14 in correspondence with the rotational range of the indicator hand 14 and in an arcuate shape around the second rotation axis P. In the present embodiment, through combination with the indicator hand 14, the sub display region 16 can display, for example, the attainment ratio with respect to a target value of an action amount, the kind of mode being executed by the timepiece 1, etc. The dial 11, the hour hand 12, the minute hand 13, and the indicator hand 14 are arranged so as to be visually recognizable through the glass 3.

Of the side surface of the timepiece case 4, buttons 17 are respectively provided at the portion corresponding to 2 O'clock and at the portion corresponding to 4 o'clock. The buttons 17 are used, for example, for time correction in which the time indicated by the hour hand 12 and the minute hand 13 is corrected, and for switching of the mode executed by the timepiece 1.

(Movement)

FIG. 2 is a sectional view of the timepiece of the first embodiment.

As shown in FIG. 2, the movement 10 is arranged between the dial 11 and the case back (not shown). The movement 10 drives the hour hand 12, the minute hand 13, and the indicator hand 14. In the following description, the direction in which the first rotation axis O, which is the rotational center of the hour hand 12 and the minute hand 13, extends is referred to as the axial direction.

Figure 3:
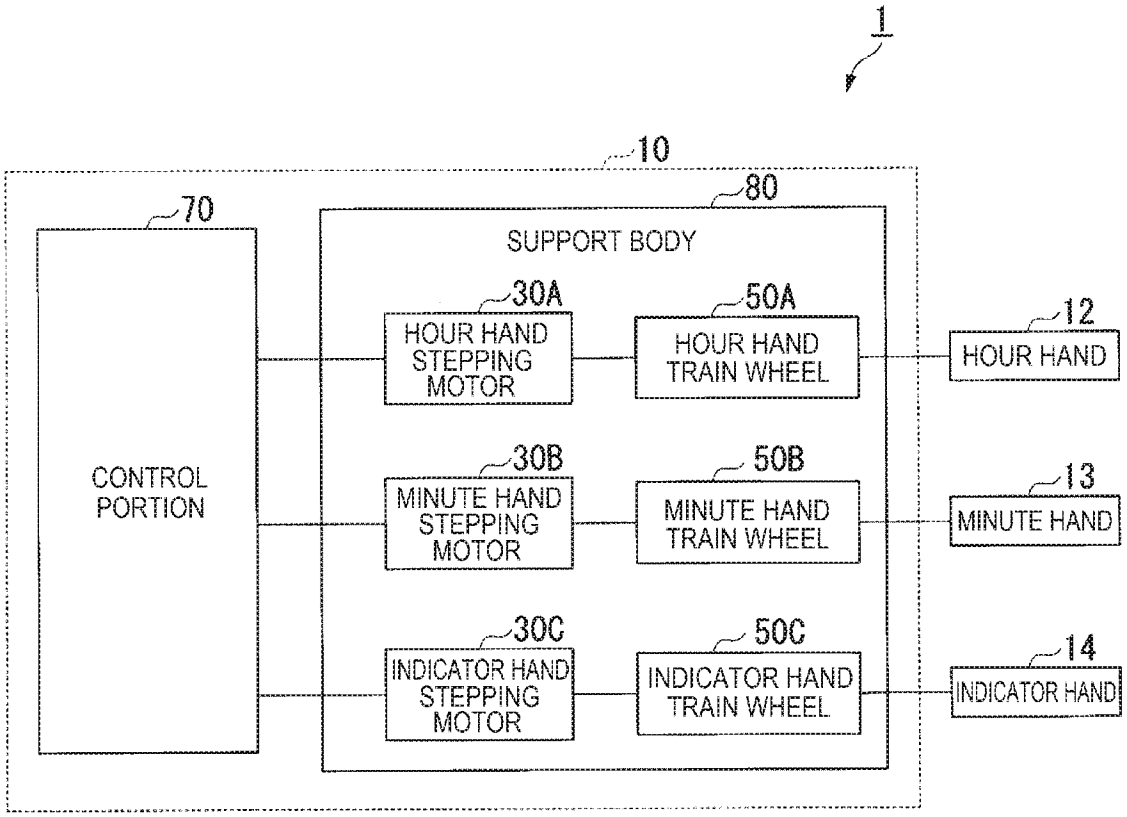
FIG. 3 is a block diagram illustrating the structure of the timepiece of the first embodiment.

FIG. 3 is a block diagram illustrating the structure of the timepiece of the first embodiment.

As shown in FIG. 3, the movement 10 is equipped with a plurality of stepping motors 30A, 30B, and 30C, a plurality of train wheels 50A, 50B, and 50C, a control portion 70, and a support body 80. The support body 80 is a main plate, a train wheel bridge or the like. For example, it forms the outer contour of the movement 10. The support body 80 supports the plurality of stepping motors 30A, 30B, and 30C, and the plurality of train wheel 50A, 50B, and 50C. The support body 80 may be formed as a separate unit detachable with respect to a timepiece main body. In this case, the movement 10 is treated as a half product or an intermediate product in contrast to the timepiece main body as the complete whole.

The plurality of stepping motors 30A, 30B, and 30C are the hour hand stepping motor 30A (second motor) driving the hour hand 12, the minute hand stepping motor 30B driving the minute hand 13, and the indicator hand stepping motor 30C (first motor) driving the indicator hand 14. In the following, the stepping motors will be simply referred to as the motors. In the following description, in the case where any one of the hour hand motor 30A, the minute hand motor 30B, and the indicator hand motor 30C is not specified, every stepping motor will be simply referred to as the motor 30.

Figure 4:
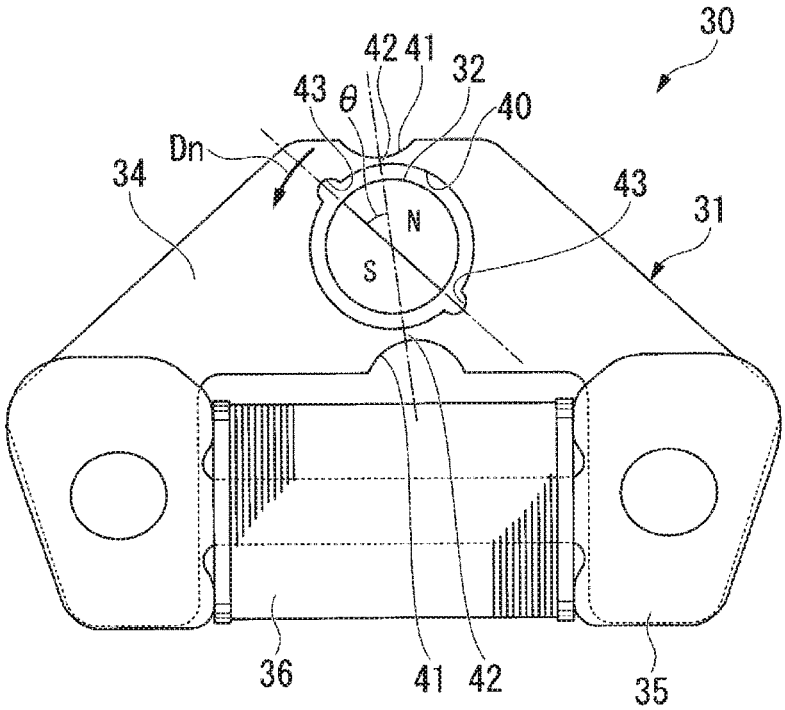
FIG. 4 is a schematic view illustrating the structure of a stepping motor according to the first embodiment.
Figure 5:
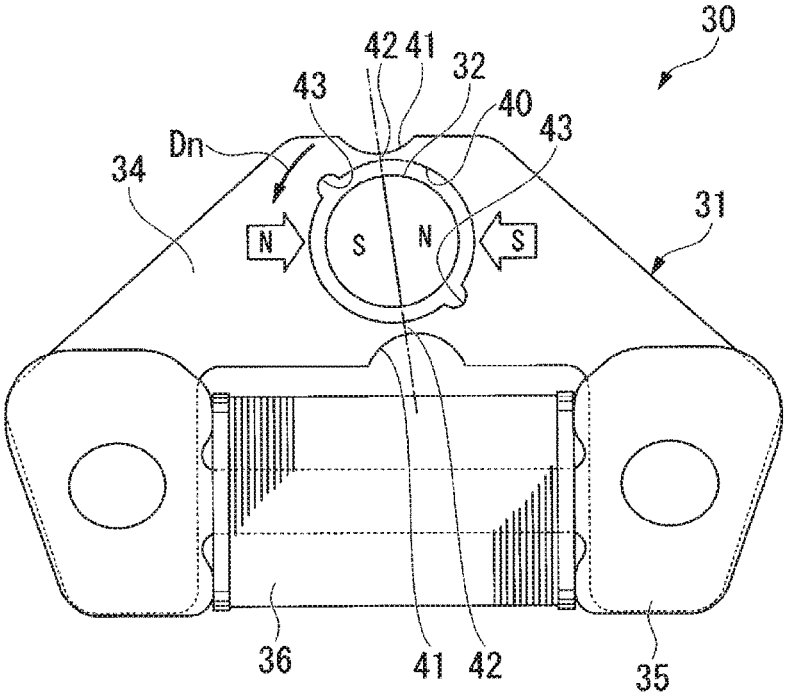
FIG. 5 is a schematic view illustrating the structure of the stepping motor of the first embodiment.

FIGS. 4 and 5 are schematic views illustrating the structure of the motor.

As shown in FIG. 4, the motor 30 is equipped with a stator 31 in which a rotor accommodating hole 40 is formed, and a rotor 32 rotatably arranged in the rotor accommodating hole 40. The motor 30 can rotate the rotor 32 in both normal and reverse rotations. In FIG. 4, an arrow Dn indicates the normal rotational direction of the rotor 32. In the present embodiment, the normal rotation (rotation in the normal direction) of the rotor 32 is a direction determined by the positional relationship between a magnetic saturation portion 42 and an inner notch 43 described below. The rotor 32 is rotated around an axis extending in the axial direction. The rotor 32 is magnetized in 2 poles in the radial direction, whereby it exhibits a magnetic polarity. The rotor 32 is rotatably supported by the support body 80. (See FIG. 3.) Formed on the rotor 32 is a pinion (not shown) in mesh with cogwheels of the train wheels 50A, 50B, and 50C.

The stator 31 is equipped with a stator yoke 34, a magnetic core 35 magnetically joined to the stator yoke 34, and a coil 36 wound around the magnetic core 35. The stator yoke 34 is formed of a plate material using a high magnetic permeability material such as permalloy. The stator yoke 34 extends in a predetermined configuration as seen from the axial direction. Formed at the intermediate portion of the stator yoke 34 is a circular rotor accommodating hole 40. The rotor accommodating hole 40 extends through the stator yoke 34 in the axial direction. The term intermediate portion is not restricted to the central portion between both ends of the stator yoke 34 but includes the inner range between both ends of the stator yoke 34.

The magnetic core 35 is formed of a high magnetic permeability material such as permalloy. The magnetic core 35 is magnetically connected to both end portions of the stator yoke 34. The above-mentioned coil 36 is wound around the magnetic coil 35. When the coil 36 is excited, a magnetic flux flows along the magnetic core 35 and the stator yoke 34.

Here, around the rotor accommodating hole 40 of the stator yoke 34, there are formed a pair of outer notches 41 cut out from the outer edge of the stator yoke 34 toward the rotor accommodating hole 40. The pair of outer notches 41 are arranged opposite each other with the rotation center of the rotor 32 therebetween. More specifically, the pair of outer notches 41 are provided at positions deviated from each other by 180° around the rotation center of the rotor 32. Each outer notch 41 is cut out in an arcuate shape. The portion of the stator yoke 34 around the rotor accommodating hole 40 is locally narrow due to each outer notch 41. The portion of the stator yoke 34 made narrow due to the outer notches 41 constitutes the magnetic saturation portion 42.

Each magnetic saturation portion 42 is formed such that it does not undergo magnetic saturation due to the magnetic flux of the rotor 32 and that it undergoes magnetic saturation to be increased in magnetic resistance when the coil 36 is excited. As a result, due to generation of magnetic saturation at each magnetic saturation portion 42, the stator yoke 34 is magnetically divided into two around the rotor accommodating hole 40. The pair of magnetic saturation portion 42 are provided so as to be opposite each other with the rotation center of the rotor 32 therebetween. More specifically, the pair of magnetic saturation portions 42 are provided at positions deviated from each other by 180° around the rotation center of the rotor 32.

As shown in FIG. 5, the pair of magnetic saturation portions 42 generate a pair of magnetic poles different from each other around the rotor accommodating hole 40 through excitation of the coil 36. The pair of magnetic poles are generated on both sides of a straight line passing through the pair of magnetic saturation portions 42. When the pair of magnetic poles are excited, the rotor 32 becomes at rest at a position where its magnetic pole axis is orthogonal to the straight line passing through the pair of magnetic saturation portions 42 (the state shown in FIG. 5). In the following, the stop position of the rotor 32 when the magnetic pole axis of the rotor 32 is orthogonal to the straight line passing through the pair of magnetic saturation portions 42 will be referred to as the intermediate rest position.

Further, as shown in FIG. 4, a pair of inner notches 43 (cutouts) are formed at the inner peripheral edge of the rotor accommodating hole 40. The pair of inner notches 43 are provided so as to be opposite each other with the rotation center of the rotor 32 therebetween. More specifically, the pair of inner notches 43 are provided at positions deviated from each other by 180° around the rotation center of the rotor 32. Each inner notch 43 is cut out in an arcuate shape. For example, a straight line passing through the pair of inner notches 43 crosses the straight line passing through the pair of magnetic saturation portions 42 at the rotation center of the rotor 32. The straight line passing through the pair of inner notches 43 is inclined with respect to the straight line passing through the pair of magnetic saturation portions 42 by a predetermined angle θ which is less than 90° in the normal rotational direction of the rotor 32. In other words, the normal rotational direction of the rotor 32 is the direction in which the straight line passing through the pair of inner notches 43 is inclined by less than 90° with respect to the straight line passing through the pair of magnetic saturation portions 42.

The inner notches 43 cause a retaining torque to act on the rotor 32. The inner notches 43 are formed as positioning portions for determining the resting position of the rotor 32 when the coil 36 is not being excited. When its magnetic pole axis is in a position where it is orthogonal to the straight line passing through the pair of inner notches 43, the rotor 32 exhibits a minimum potential energy, and is at rest in a stable manner. In the following, the stop position of the rotor 32 when the magnetic pole axis of the rotor 32 is orthogonal to the straight line passing through the pair of inner notches 43 will be referred to as the stable rest position. When the pair of magnetic poles of the stator 31 are continued to be excited, the rotor 32 rests at the intermediate rest position, and when the excitation of the pair of magnetic poles of the stator 31 is stopped, it rests at the stable rest position.

As shown in FIG. 3, the plurality of train wheels 50A, 50B, and 50C are the hour hand train wheel 50A transmitting the output of the hour hand motor 30A to the hour hand 12, the minute hand train wheel 50B transmitting the output of the minute hand motor 30B to the minute hand 13, and the indicator hand train wheel 50C transmitting the output of the indicator hand motor 30C to the indicator hand 14. The plurality of train wheels 50A, 50B, and 50C have at least one cogwheel rotatably supported by the support body 80. The hour hand train wheel 50A is connected to the rotor 32 of the hour hand motor 30A. The minute hand train wheel 50B is connected to the rotor 32 of the minute hand motor 30B. The indicator hand train wheel 50C is connected to the rotor 32 of the indicator hand motor 30C. In the following, the rotor 32 of the indicator hand motor 30C will be referred to as the indicator hand rotor 32.

As shown in FIG. 2, the hour hand train wheel 50A has an hour wheel 51 (second wheel). The hour wheel 51 is arranged coaxially with the first rotation axis O. The hour wheel 51 is provided so as to be rotatable around the first rotation axis O. The hour wheel 51 is equipped with a first shaft portion 52 protruding from the dial 11 to a glass 3 side. (See FIG. 1.) The first shaft portion 52 is formed in a cylindrical configuration extending along the first rotation axis O. The first shaft portion 52 is the first output shaft 21. The hour hand 12 is mounted to the distal end of the first shaft portion 52. The hour wheel 51 is rotated and driven in both directions by the hour hand motor 30A. By causing the rotor 32 of the hour hand motor 30A to make normal rotation, the hour wheel 51 rotates clockwise as seen from the glass 3 side, causing the hour hand 12 to rotate clockwise.

The minute hand train wheel 50B has a minute hand wheel 54. The minute hand wheel 54 is arranged coaxially with the first rotation axis O. The minute hand wheel 54 is provided so as to be rotatable around the first rotation axis O. The minute hand wheel 54 is equipped with a second shaft portion 55 protruding from the dial 11 to the glass 3 side. The second shaft portion 55 is formed in a columnar or a cylindrical configuration extending along the first rotation axis O. The second shaft portion 55 is inserted into the first shaft portion 52 of the hour wheel 51, and protrudes to the glass 3 side beyond the first shaft portion 52 of the hour wheel 51. The second shaft portion 55 is the first output shaft 21. The minute hand 13 is mounted to the distal end of the second shaft portion 55. The minute hand 13 is arranged on the glass 3 side of the hour hand 12. The minute hand wheel 54 is rotated and driven in both directions by the minute hand motor 30B. By causing the rotor 32 of the minute hand motor 30B to make normal rotation, the minute hand wheel 54 rotates clockwise as seen from the glass 3 side, causing the minute hand 13 to rotate clockwise.

The indicator hand train wheel 50C has an indicator hand wheel 57 (first wheel). The indicator hand wheel 57 is arranged coaxially with the second rotation axis P. The indicator hand wheel 57 is provided so as to be rotatable around the second rotation axis P. The indicator hand wheel 57 is equipped with a third shaft portion 58 protruding from the dial 11 to the glass 3 side. The third shaft portion 58 is formed in a columnar or a cylindrical configuration extending along the second rotation axis P. The third shaft portion 58 is the second output shaft 22. The indicator hand 14 is mounted to the distal end of the third shaft portion 58. The indicator hand 14 is arranged on the dial 11 side of the hour hand 12. The indicator hand wheel 57 is rotated and driven in both directions by the indicator hand motor 30C. By causing the indicator hand rotor 32 to make normal rotation, the indicator hand wheel 57 rotates clockwise as seen from the glass 3 side, causing the indicator hand 14 to rotate clockwise.

The indicator hand 14 can come into contact with a part of the outer peripheral surface of the first output shaft 21. In the present embodiment, on the outer peripheral surface of the first shaft portion 52 of the hour wheel 51, there is provided a contact portion 60 the indicator hand 14 can be brought into contact with. The contact portion 60 is provided at the same position as the indicator hand 14 in the axial direction. That is, the contact portion 60 is provided so as to overlap the indicator hand 14 as seen from the direction orthogonal to the axial direction. The contact portion 60 is provided on the dial 11 side of a mounting portion 52*a* of the hour hand 12 at the first shaft portion 52 of the hour wheel 51.

Figure 6:
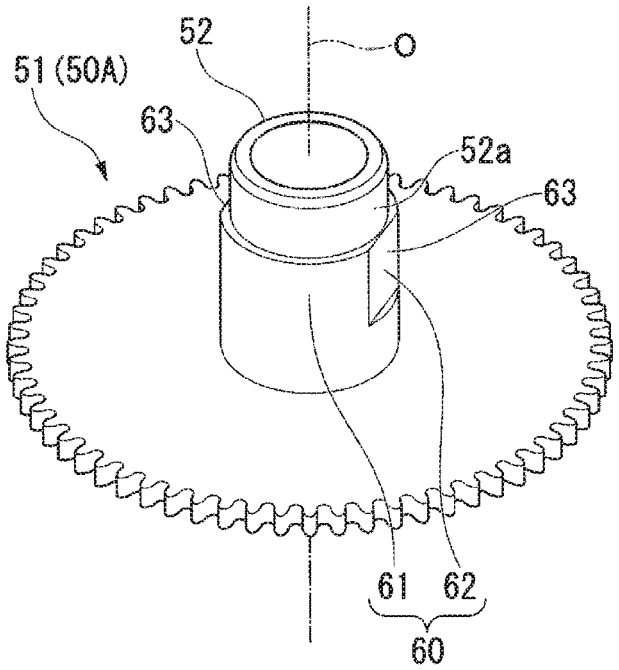
FIG. 6 is a perspective view of an hour wheel according to the first embodiment.

FIG. 6 is a perspective view of the hour wheel of the first embodiment.

As shown in FIG. 6, the distance of the contact portion 60 from the first rotation axis O varies in accordance with the position in the peripheral direction around the first rotation axis O. The contact portion 60 is equipped with a circumferential surface portion 61 extending in the axial direction and in the peripheral direction around the first rotation axis O in a fixed radius of curvature, and a small diameter portion 62 of a smaller diameter than the circumferential surface portion 61. The small diameter portion 62 is formed by face-cutting the outer peripheral surface of the first shaft portion 52 of the hour wheel 51. In the present embodiment, the small diameter portion 62 is equipped with a pair of face-cut portions 63 formed by 2-face cutting. The pair of face-cut portions 63 are surfaces of the same configuration parallel to each other. As a result, the contact portion 60 is formed in two-fold symmetry with respect to the first rotation axis O.

The contact portion 60 is formed such that when the hour wheel 51 is rotated in a state in which the indicator hand 14 is held in contact with the contact portion 60 from the upstream side in the clockwise direction around the second rotation axis P, the indicator hand rotor 32 rotates to a greater degree than the predetermined angle θ. More specifically, the contact portion 60 is formed such that the angle difference between the position of the indicator hand rotor 32 in the state in which the indicator hand 14 is in contact with the small diameter portion 62 and the position of the indicator hand rotor 32 in the state in which the indicator hand 14 is in contact with the circumferential surface portion 61 is larger than the above-mentioned predetermined angle θ.

Figure 7:
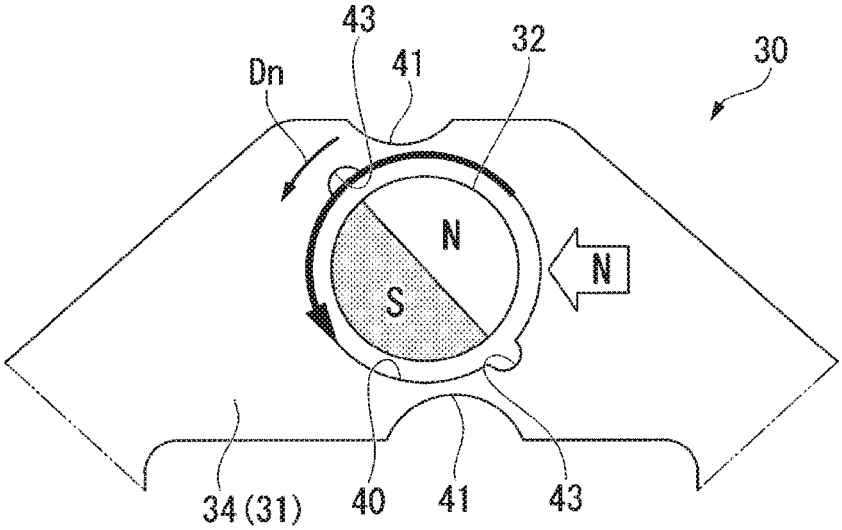
FIG. 7 is an operational chart illustrating the normal rotation operation of the stepping motor of the first embodiment.

As shown in FIG. 3, the control portion 70 is, for example, a motor driver IC (integrated circuit). The control portion 70 generates a drive signal driving the motor 30, and applies the generated drive signal to the coil 36 of the motor 30 to drive the rotor 32. As the drive signal, there are a normal rotation pulse and a reverse rotation pulse. The normal rotation pulse causes the rotor 32 at the stable rest position to make normal rotation by 180°. As shown in FIG. 7, the normal rotation pulse excites the pair of magnetic poles of the stator 31 opposite the magnetic poles of the rotor 32 so as to cause the rotor 32 to repel.

The reverse rotation pulse causes the rotor 32 at the stable rest position to make reverse rotation by 180°. For example, the reverse rotation pulse includes a first pulse of the same polarity as the normal rotation pulse, a second pulse of an opposite polarity to the first pulse, and a third pulse of an opposite polarity to the second pulse.

Figure 8:
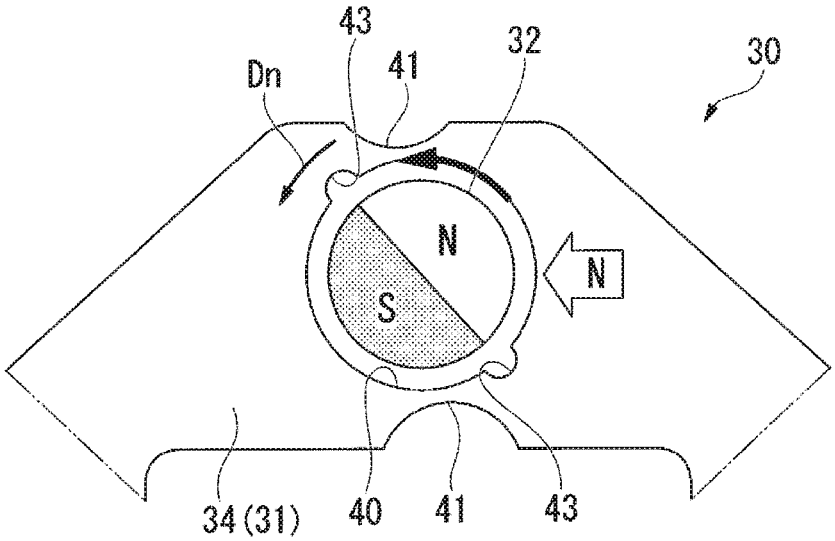
FIG. 8 is an operational chart illustrating the reverse rotation operation of the stepping motor of the first embodiment.

As shown in FIG. 8, the first pulse excites the pair of magnetic poles of the stator 31 opposite the magnetic poles of the rotor 32 so as to cause the rotor 32 to repel. The first pulse causes the rotor 32 to make normal rotation from the stable rest position. That is, the first pulse reversely swings in the normal rotational direction the rotor 32, which is to make reverse rotation. For example, the first pulse causes the rotor 32 to make normal rotation to a position where it does not go beyond the position where the magnetic pole axis of the rotor 32 and the straight line passing through the pair of magnetic saturation portions 42 are parallel to each other.

Figure 9:
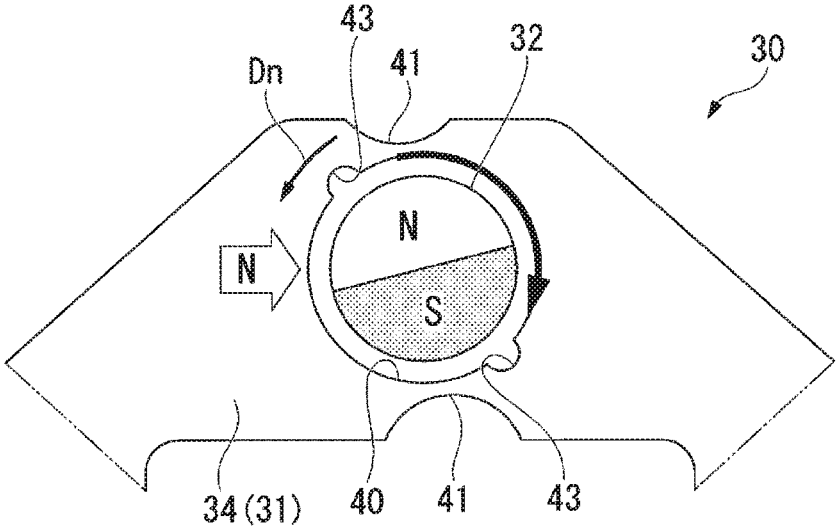
FIG. 9 is an operational chart illustrating the reverse rotation operation of the stepping motor of the first embodiment.

The second pulse is applied subsequent to the first pulse. As shown in FIG. 9, the second pulse excites the pair of magnetic poles of the stator 31 such that there results a polarity which is reverse to that at the time of application of the first pulse. The second pulse attracts the rotor 32 having been caused to make normal rotation by the first pulse, and causes it to make reverse rotation. That is, the second pulse imparts a return reaction to the rotor 32 reversely swung by the first pulse. For example, the second pulse causes the rotor 32 to make reverse rotation to a position beyond the intermediate rest position.

The setting of these pulses is not restricted to the above-mentioned relationship with the position of the rotor 32 so long as it is a setting allowing utilization of the reverse swing by the first pulse and the return reaction due to the second pulse.

Figure 10:
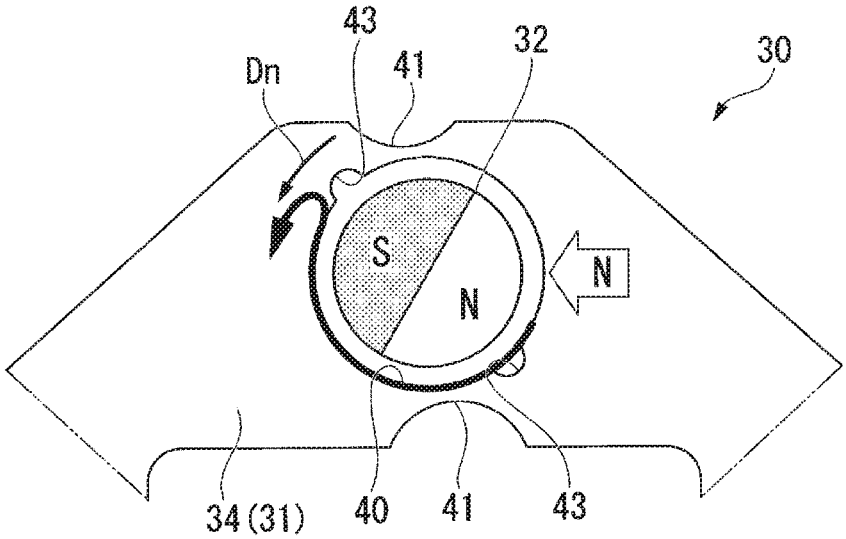
FIG. 10 is an operational chart illustrating the reverse rotation operation of the stepping motor of the first embodiment.

The third pulse is applied subsequent to the second pulse. As shown in FIG. 10, the third pulse excites the pair of magnetic poles of the stator 31 opposite the magnetic poles of the rotor 32 so as to cause the rotor 32 to repel. The third pulse further reverses the rotor 32, which has been reversed by the second pulse. For example, the third pulse reverses the rotor 32 to a position beyond the stable rest position, and is continued to be applied until the rotational direction is turned to normal. After the application of the third pulse is stopped, the rotor 32 converges the vibration through free vibration toward the stable rest position.

Here, a stuck state in which the indicator hand 14 cannot be driven will be described.

Figure 11:
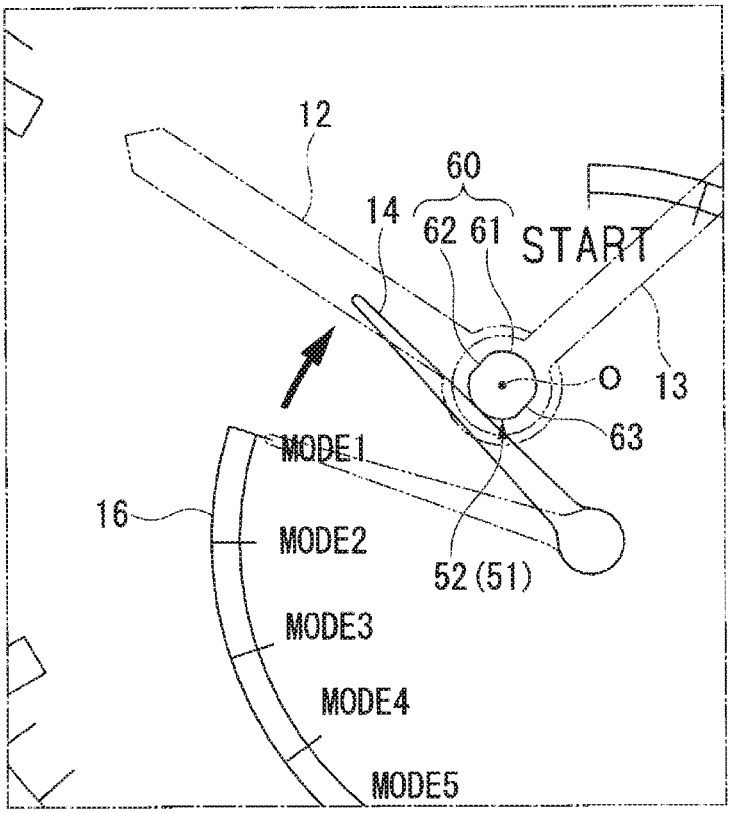
FIG. 11 is a plan view illustrating an example of the operation in the case where an indicator hand comes into contact with the hour wheel in the timepiece according to the first embodiment.
Figure 12:
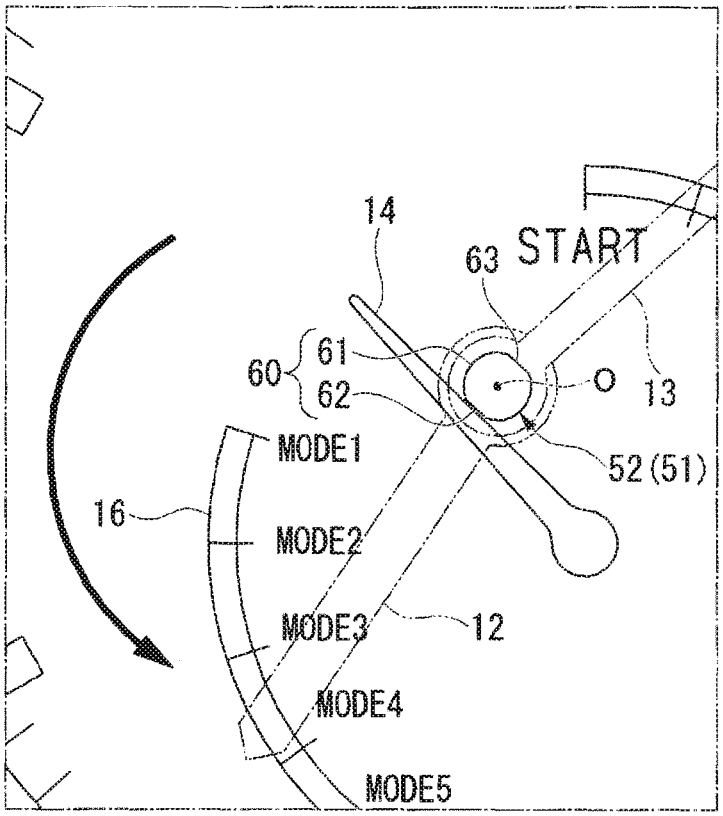
FIG. 12 is a plan view illustrating an example of the operation in the case where the indicator hand comes into contact with the hour wheel of the timepiece of the first embodiment.
Figure 13:
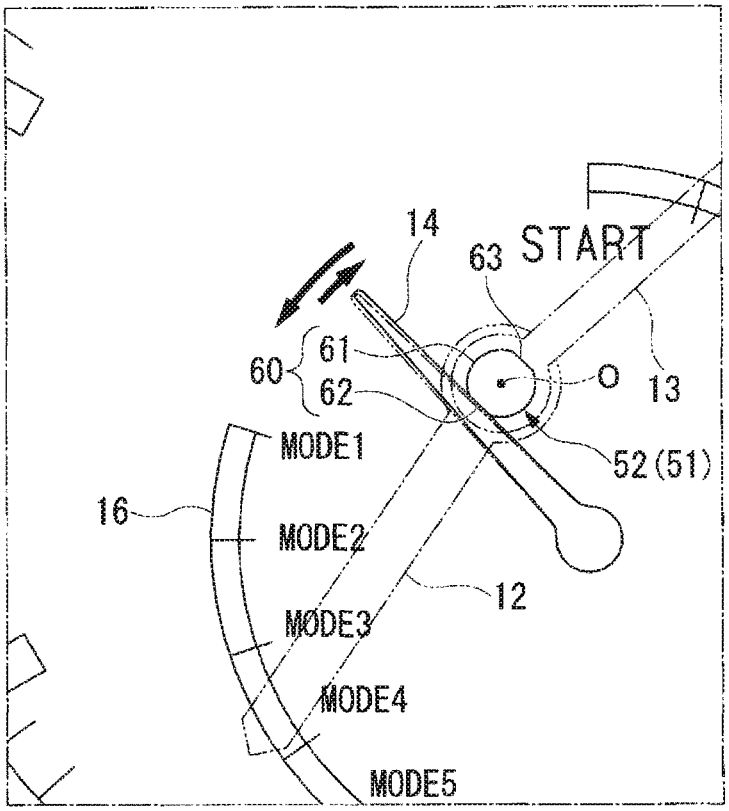
FIG. 13 is a plan view illustrating an example of the operation in the case where the indicator hand comes into contact with the hour wheel of the timepiece of the first embodiment.

FIGS. 11 through 13 are plan views illustrating an example of the operation in the case where the indicator hand comes into contact with the hour wheel in the timepiece of the first embodiment.

As shown in FIG. 11, when the indicator hand 14 deviates clockwise from the normal rotational range to come into contact with the first shaft portion 52 of the hour wheel 51, there may arise a stuck state in which the indicator hand 14 cannot be driven.

For example, when the indicator hand rotor 32 is at the stable rest position in the state in which the indicator hand 14 is held in contact with the first shaft portion 52 from the upstream side in the clockwise direction, it is impossible to cause the indicator hand rotor 32 to make normal rotation by the first pulse, which is a reversing pulse. As a result, the indicator hand rotor 32 cannot be reversed by the reversing pulse, resulting in a stuck state in which the indicator hand 14 can be driven neither in the clockwise direction nor in the counterclockwise direction.

In view of this, in order to escape from the stuck state, the control portion 70 repeats the process of inputting a reversing pulse to the indicator hand motor 30C once each time a normal rotation pulse or a reverse rotation pulse is input a predetermined number of times at the time, for example, of resetting. For example, each time a reverse rotation pulse is input to the hour hand motor 30A once, the control portion 70 repeats the process of inputting a reverse rotation pulse once to the indicator hand motor 30C. The control portion 70 may perform the operation of inputting a pulse to the hour hand motor 30A and the operation of inputting a pulse to the indicator hand motor 30C simultaneously or alternately. In the present embodiment, the contact portion 60 of the hour wheel 51 is formed in two-fold symmetry with respect to the first rotation axis O, so that the control portion 70 rotates the hour wheel 51, for example, by at least 180°.

As a result, as shown in FIG. 12, in the case where the indicator hand 14 has been held in contact with the circumferential surface portion 61 of the hour wheel 51, the small diameter portion 62 rotates to a position where it is opposite the indicator hand 14, whereby a gap is formed between the indicator hand 14 and the first shaft portion 52 of the hour wheel 51. In the case where the indicator hand 14 has been held in contact with the small diameter portion 62 of the hour wheel 51, the hour wheel 51 rotates, whereby the indicator hand 14 is pressed in the counterclockwise direction due to the diameter difference of the contact portion 60 of the hour wheel 51. Then, the indicator hand 14 comes into contact with the circumferential surface portion 61. As a result, the rotation of the hour wheel 51 proceeds to a position where the small diameter portion 62 of the hour wheel 51 faces the indicator hand 14 again, whereby a gap is formed between the indicator hand 14 and the first shaft portion 52 of the hour wheel 51.

As shown in FIG. 13, in the state in which a gap is formed between the indicator hand 14 and the first shaft portion 52 of the hour wheel 51, the indicator hand 14 can rotate clockwise. As a result, the indicator hand rotor 32 can make normal rotation by the first pulse, which is the reversing pulse. Thus, the indicator hand rotor 32 can make reverse rotation by the reversing pulse. Further, in the process in which the indicator hand 14 is pressed by the contact portion 60 of the hour wheel 51 to rotate counterclockwise, a rotational force in the reversing direction is imparted to the indicator hand rotor 32. Thus, also through the imparting of a rotational force in the reversing direction to the rotor 32, the indicator hand rotor 32 can escape from the state in which it is unrotatable.

While in the above-described case the indicator hand rotor 32 is at the stable rest position in the state in which the indicator hand 14 is in contact with the first shaft portion 52 from the upstream side in the clockwise direction, it is also possible in other cases to escape from the stuck state in a similar manner. For example, there can arise a case in which the indicator hand rotor 32 is at the intermediate rest position in the state in which the indicator hand 14 is in contact with the first shaft portion 52 from the upstream side in the clockwise direction. In this case, even if the magnetic pole of the stator 31 is excited, the magnetic flux is parallel to the magnetic pole axis of the indicator hand rotor 32, so that the indicator hand rotor 32 does not rotate, and the indicator hand 14 cannot be driven. In view of this, by rotating the hour wheel 51, it is possible to cause the indicator hand rotor 32 to rotate from the intermediate rest position. As a result, a rotational force is imparted to the indicator hand rotor 32, so that the indicator hand rotor 32 can escape from the state in which it is unrotatable.

As described above, in the movement 10 and the timepiece 1 of the present embodiment, on the outer peripheral surface of the first shaft portion 52 of the hour wheel 51, there is provided the contact portion 60 with which the indicator hand 14 can come into contact. The distance of the contact portion 60 from the first rotation axis O varies in accordance with the position in the peripheral direction around the first rotation axis O. In this structure, by rotating the hour wheel 51 in the state in which the indicator hand 14 is in contact with the contact portion 60 of the first shaft portion 52 of the hour wheel 51, it is possible to provide a gap between the indicator hand 14 and the first shaft portion 52 of the hour wheel 51, or to press and displace the indicator hand 14. As a result, even in the case where the indicator hand 14 comes into contact with the hour wheel 51 to place the indicator hand rotor 32 in a state in which it is unrotatable, it is possible to rotate the indicator hand rotor 32. Thus, it is possible to suppress generation of malfunction of the indicator hand 14.

Further, the contact portion 60 has the face-cut portion 63. In this structure, due to the face-cut portion 63, it is possible to vary the distance of the contact portion 60 from the first rotation axis O in accordance with the position in the peripheral direction around the first rotation axis O. Thus, it is possible to form the movement 10 and the timepiece 1 providing the above-mentioned effect.

The contact portion 60 has the pair of face-cut portions 63. In this structure, by rotating the hour wheel 51 by at least 180°, it is possible to provide a gap between the indicator hand 14 and the first shaft portion 52 of the hour wheel 51, or to press and displace the indicator hand 14. That is, as compared with the case where only one face-cut portion 63 is provided, it is possible to provide a gap between the indicator hand 14 and the first shaft portion 52 of the hour wheel 51, or to press and displace the indicator hand 14 more quickly.

Further, at least a part of the contact portion 60 constitutes the circumferential surface portion 61 without depending on the distance of the pair of face-cut portions 63 from the rotation axis O, so that the maximum distance of the contact portion 60 from the first rotation axis O is not changed even if the face-cut portions 63 are provided. That is, as compared with the case where three or more face-cut portions are provided, it is possible to provide a larger gap between the indicator hand 14 and the first shaft portion 52 of the hour wheel 51, or to press the indicator hand 14 and displace it to a greater degree.

As described above, even in a case where the indicator hand 14 comes into contact with the hour wheel 51 to place the indicator hand rotor 32 in a state in which it is unrotatable, it is possible to rotate the indicator hand rotor 32 more reliably. Thus, it is possible to suppress generation of malfunction of the indicator hand 14.

The indicator hand motor 30C is equipped with the stator 31 having one coil 36, and the 2-pole indicator hand rotor 32. In this structure, when reversing the indicator hand rotor 32, there are cases where, like the first pulse of the above-mentioned reversing pulses, a pulse causing the indicator hand rotor 32 to make normal rotation is first applied to the coil 36. Thus, when the indicator hand 14 is brought into contact with the first shaft portion 52 of the hour wheel 51 through normal rotation of the indicator hand rotor 32, it is impossible to cause the indicator hand rotor 32 to make further normal rotation, so that the indicator hand rotor 32 is placed in a state in which it is irreversible. Thus, through combination with the hour wheel 51 having the above-mentioned contact portion 60, it is possible to provide a movement 10 capable of escaping from the state in which the indicator hand rotor 32 is irreversible.

In the stator yoke 34, the straight line passing through the pair of inner notches 43 is inclined with respect to the straight line passing through the pair of magnetic saturation portions 42 by the predetermined angle θ in the normal rotation direction of the indicator hand rotor 32. The contact portion 60 is formed such that when the hour wheel 51 is rotated in the state in which the indicator hand 14 is held in contact with the contact portion 60 from the upstream side in the clockwise direction, the indicator hand rotor 32 rotates to a greater degree than the predetermined angle θ. In this structure, in the state in which the indicator hand rotor 32 is at the intermediate rest position, the indicator hand rotor 32 strives to make normal rotation toward the stationary stable position. In the case where the indicator hand 14 is brought into contact with the circumferential surface portion 61 of the hour wheel 51 from the upstream side in the clockwise direction, when the indicator hand 14 is rotated clockwise so as to rotate the hour wheel 51 to bring the small diameter portion 62 of the hour wheel 51 into contact with the indicator hand 14, the indicator hand rotor 32 makes normal rotation by the predetermined angle θ to the stationary stable position, and stops at the stationary stable position. When the hour wheel 51 is further rotated, a gap is formed between the indicator hand 14 and the first shaft portion 52 of the small diameter portion 62 of the hour wheel 51 as the indicator hand rotor 32 stops. As a result, it is possible to cause the indicator hand rotor 32 to make normal rotation, so that it is possible to reverse the indicator hand rotor 32 by a reversing pulse. Thus, it is possible to suppress generation of malfunction of the indicator hand 14.

In the case where the indicator hand 14 comes into contact with the contact portion 60 of the hour wheel 51, each time a normal rotation pulse or a reverse rotation pulse is applied to the hour hand motor 30A a predetermined number of times, the control portion 70 applies a reverse rotation pulse to the indicator hand motor 30C once. In this structure, it is possible to periodically apply a reverse rotation pulse to the indicator hand motor 30C. As a result, even when the contact position of the indicator hand 14 on the contact portion 60 of the hour wheel 51 is unclear, it is possible to apply a reverse rotation pulse to the indicator hand motor 30C in the state in which a gap is formed between the indicator hand 14 and the first shaft portion 52 of the hour wheel 51, or in the state in which the indicator hand 14 is pressed and displaced by the hour wheel 51.

Furthermore, in the present embodiment, each time a normal rotation pulse or a reverse rotation pulse is applied to the hour hand motor 30A once, the control portion 70 applies a reverse rotation pulse to the indicator hand motor 30C once. As a result, it is possible to reliably apply a reverse rotation pulse to the indicator hand motor 30C in the state in which a gap is formed between the indicator hand 14 and the first shaft portion 52 of the hour wheel 51, or in the state in which the indicator hand 14 is pressed and displaced by the hour wheel 51.

Thus, it is possible to reliably escape from the state in which the indicator hand rotor 32 is irreversible.

While in the present embodiment the small diameter portion 62 of the contact portion 60 of the hour wheel 51 is provided with the pair of face-cut portions 63, this should not be construed restrictively. Three or more face-cut portions may be provided so long as it is possible to secure the requisite diameter difference (face-cutting amount) for the contact portion of the hour wheel. Providing a large number of face-cut portions is effective since it reduces the angle by which the hour wheel is rotated at the time of escapement from the stuck state. For example, by providing four face-cut portions 63 on the first shaft portion 52 of the hour wheel 51 shown in FIG. 6, it is possible for the rotational angle of the hour wheel 51 at the time of escapement from the stuck state to be 90°. Providing a large number of face-cut portions, however, involves an increase in production cost, so that the present embodiment adopts two-face cutting.

Second Embodiment

Next, the second embodiment will be described with reference to FIG. 14. The second embodiment differs from the first embodiment in that a contact portion 160 of the hour wheel 51 is an offset circumferential surface. Apart from what is described below, the second embodiment is the same as the first embodiment.

Figure 14:
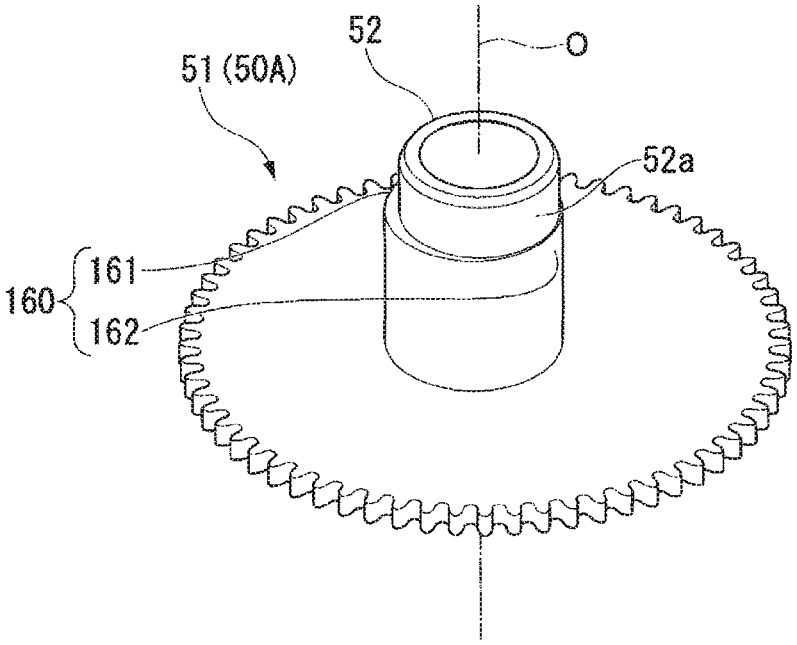
FIG. 14 is a perspective view of an hour wheel according to a second embodiment.

FIG. 14 is a perspective view of the hour wheel of the second embodiment.

As shown in FIG. 14, of the first shaft portion 52 of the hour wheel 51 of the second embodiment, the portion adjacent to the dial 11 side with respect to the mounting portion 52*a* of the hour hand 12 is formed in a cylindrical configuration offset with respect to the first rotation axis O. As a result, of the outer peripheral surface of the first shaft portion 52 of the hour wheel 51, the contact portion 160 with which the indicator hand 14 can come into contact is formed as a circumferential surface offset with respect to the first rotation axis O. The distance of the contact portion 160 from the first rotation axis O varies in accordance with the position in the peripheral direction around the first rotation axis O. The contact portion 160 is equipped with a large diameter portion 161 the distance of which from the first rotation axis O is maximum, and a small diameter portion 162 the distance of which from the first rotation axis O is minimum. The contact portion 160 is formed in one-fold symmetry with respect to the first rotation axis O.

The contact portion 160 is formed such that when the hour wheel 51 is rotated in the state in which the indicator hand 14 is held in contact with the contact portion 160 from the upstream side in the clockwise direction around the second rotation axis P, the indicator hand rotor 32 rotates to a greater degree than the above-mentioned predetermined angle θ. More specifically, the contact portion 160 is formed such that the angle difference between the position of the indicator hand rotor 32 in the state in which the indicator hand 14 is in contact with the small diameter portion 162 and the position of the indicator hand rotor 32 in the state in which the indicator hand 14 is in contact with the large diameter portion 161 is not less than the above-mentioned predetermined angle θ.

In this way, the contact portion 160 of the hour wheel 51 is offset with respect to the first rotation axis O, so that by rotating the hour wheel 51 in the state in which the indicator hand 14 is in contact with the contact portion 160 of the first shaft portion 52 of the hour wheel 51, it is possible to provide a gap between the indicator hand 14 and the first shaft portion 52 of the hour wheel 51, or to press and displace the indicator hand 14. Thus, it is possible to provide the same effect as that of the hour wheel 51 of the first embodiment.

Also in the case where the hour wheel 51 of the second embodiment is employed, the control portion 70 conducts the same processing as that of the first embodiment in order to escape from the stuck state in which it is impossible to drive the indicator hand 14. In the present embodiment, the contact portion 160 is formed in one-fold symmetry with respect to the first rotation axis O, so that the hour wheel 51 is rotated by at least 360°.

The present invention is not restricted to the embodiments described above with reference to the drawings but will allow various modifications within the scope of its technical idea.

For example, while in the above embodiments the control portion 70 constitutes a part of the movement 10, the control portion may be provided separately from the movement.

Further, while in the above embodiments the face-cut portion 63 or the offset outer peripheral surface is provided on the first shaft portion 52 of the hour wheel 51 in order to vary the distance of the contact portion 60, 160 from the first rotation axis O in accordance with the position in the peripheral direction, this should not be construed restrictively. For example, a protrusion may be provided on the outer peripheral surface of the first shaft portion 52 of the hour wheel 51.

Further, while in the above embodiments the hour hand 12 and the minute hand 13 are driven by different motors, this should not be construed restrictively. It is only necessary for the indicator hand 14 and the hour wheel 51 to be driven independently of each other, and the hour wheel 51 and the minute hand wheel 54 may be connected to each other via a train wheel, and the hour hand 12 and the minute hand 13 may be formed so as to be driven by one motor.

Apart from the above, the components of the above-described embodiments can be replaced by other well-known components as appropriate without departing from the scope of the invention. Further, the above-described embodiments may be combined with each other as appropriate.

What is claimed is:

1. A timepiece movement comprising:

a first wheel which is provided so as to be rotatable and to which a hand is mounted;

a first motor rotating and driving the first wheel in both directions;

a second wheel provided so as to be rotatable around an axis different from a rotation axis of the first wheel and having a shaft portion which extends along the axis and on an outer peripheral surface of which there is provided a contact portion the hand can abut, with the distance of the contact portion from the axis varying in accordance with a position in a peripheral direction around the axis; and a second motor rotating and driving the second wheel and provided separately from the first motor.

2. The timepiece movement according to claim 1, wherein the contact portion has a face-cut portion.

3. The timepiece movement according to claim 1, wherein the contact portion has a pair of face-cut portions provided parallel to each other.

4. The timepiece movement according to claim 1, wherein the contact portion is offset with respect to the axis.

5. The timepiece movement according to claim 1, wherein the first motor is equipped with a stator having one coil, and a 2-pole rotor.

6. The timepiece movement according to claim 5, wherein the stator is equipped with a stator yoke having a rotor accommodating hole in which the rotor is arranged;

the stator yoke is equipped with a pair of magnetic saturation portions generating a pair of magnetic poles different from each other around the rotor accommodating hole through excitation of the coil;

the pair of magnetic saturation portions are provided so as to be opposite each other with the rotation center of the rotor therebetween;

in the rotor accommodating hole, there are formed a pair of cutout portions exerting a retaining torque to the rotor;

the pair of cutout portions are provided so as to be opposite each other with the rotation center of the rotor therebetween;

a straight line passing through the pair of cutout portions is inclined by a predetermined angle in the normal rotation direction of the rotor with respect to a straight line passing through the pair of magnetic saturation portions; and the contact portion is formed such that when normally rotating the rotor, when the second wheel is rotated in a state in which the hand is held in contact with the contact portion from the upstream side in the hand displacement direction, the rotor rotates to a greater degree than the predetermined angle.

7. The timepiece movement according to claim 1, further comprising a control portion controlling the first motor and the second motor, wherein in the case where the hand comes into contact with the contact portion of the second wheel, each time a pulse rotating the second wheel is applied to the second motor a predetermined number of times, the control portion applies a pulse rotating the hand away from the second wheel to the first motor once.

8. The timepiece movement according to claim 7, wherein the predetermined number of times is one.

9. A timepiece comprising:

the timepiece movement as claimed in claim 1;

a first hand mounted to the first wheel; and a second hand mounted to the second wheel.

* * * * *